United States Patent [19]

Schlueter

[11] 3,945,595

[45] Mar. 23, 1976

[54] SHELF SUPPORT MEMBER

[75] Inventor: Ernest Schlueter, Troy, N.Y.

[73] Assignee: Simmons Fastener Corporation, Albany, N.Y.

[22] Filed: Feb. 21, 1975

[21] Appl. No.: 551,758

[52] U.S. Cl. ..... 248/239; 248/216

[51] Int. Cl.[2]A47G 29/02; F16B 33/04; F16B 19/00; F16B 13/04

[58] Field of Search ..... 248/239, 216; 24/217, 219; 85/30, 10

[56] References Cited

UNITED STATES PATENTS

| | | | |
|---|---|---|---|
| 1,375,633 | 4/1921 | Hamilton | 85/10 R |
| 1,940,534 | 12/1933 | Caughey | 85/30 |
| 2,179,603 | 11/1939 | Tinnerman | 248/239 |
| 2,657,894 | 11/1953 | Sklenar | 248/239 |
| 2,665,101 | 1/1954 | Janos | 248/239 |
| 3,335,633 | 8/1967 | Seckerson | 85/30 X |

*Primary Examiner*—J. Franklin Foss
*Attorney, Agent, or Firm*—Eliot S. Gerber

[57] ABSTRACT

A refrigerator shelf support member for use with those refrigerators having a sheet metal internal wall panel and which is inserted through the wall comprises a shelf support member and a steel fastener. The steel fastener is a flat member having a pointed tip, two outwardly curved portions outwardly and oppositely directed from the tip, and two tapered portions, all of which portions of the steel fastener protrude from the shelf support member.

4 Claims, 7 Drawing Figures

SHELF SUPPORT MEMBER

BACKGROUND OF THE INVENTION

The present invention relates to shelf support members for supporting the shelves in a refrigerator having an internal sheet metal wall and for joining two or more thin sheet metal panels.

At the present time refrigerators are manufactured with various types of internal walls, i.e., liners. The internal wall of the refrigerator is separated from the exterior wall by insulation, for example, of foamed plastic such as foam polystyrene or foam polyurethane. It is generally desired that the shelves in the refrigerator, used to support the foodstuffs within the refrigerator, are not permanently attached to the internal side walls of the refrigerator but may be moved from one level to another. This enables the user to vary the shelf heights and distances between shelves to accord with the height of the bottles or other foodstuffs within the refrigerator. For example, the shelves may be temporarily removed so that the refrigerator will accommodate a large turkey or a large pot or the shelves may be moved upwardly or downwardly to accommodate tall bottles.

There have been many proposals for various types of shelf support members. For example, if the internal walls of the refrigerator are of molded plastic, it is possible to mold extending tabs as integral parts of the internal refrigerator side walls. These tabs may then serve as the shelf supports. However, if the internal side wall of the refrigerator is of sheet metal, it is not possible to integrally mold the shelf support as part of the wall. Rather, the shelf support members must be separate members which are fastened to the wall.

To provide flexibility of shelf arrangements, it is known to use a large number of shelf support members which are knobs or other shapes of protruding members and which are fastened in place by being secured through the internal wall of the refrigerator. The fastening of such shelf support members to the internal wall of a refrigerator when the internal wall is of sheet metal presents various problems. One problem arises because it is essential that the shelf support member be firmly fixed in position. It is an accepted industry standard that each individual shelf support member should support a minimum of 50 pounds. A further problem arises because it is a further requirement that the shelf support member not become loosened with the passage of time, for example, after it has received a considerable number of sideways forces due to the insertion and removal of the shelves as well as occasional bumps received when bottles and other food containers are removed or inserted into the refrigerator. It is still a further requirement that the part not deteriorate in usage or become discolored.

Some of the shelf support members which have been proposed meet these various requirements and some of them have been used in the past. However, there has been a constant demand that the shelf support members should be low in price and should be readily fastened to the refrigerator wall. Both of these requirements relate to the overall cost of inserting a set of shelf support members in a refrigerator. With the ravages of inflation and the cost-consciousness of consumers in purchasing large household appliances such as refrigerators and freezers, the engineers and purchasing agents of refrigerator manufacturers have been very conscious of the total cost of furnishing a refrigerator with shelf supporting members and they have sought means to lower such costs. The problem of securing a shelf support member in a sheet metal panel is particularly acute if the sheet metal panel is thin, as a thin panel may provide less frictional engagement to hold the shelf support member.

Consequently, it is an objective of the present invention to provide a shelf support member which will be low in cost and which will be self-piercing so as not to require drilling or otherwise forming holes in the refrigerator liner before insertion of the shelf support member.

It is a further objective of the present invention to provide such a shelf support member which is adapted for the automatic piercing of the internal wall of the refrigerator by machine.

It is a further objective of the present invention to provide such a shelf support member which will firmly support a shelf of a refrigerator and meet the standard of supporting at least 50 pounds placed on each individual shelf support member and further which will retain its ability to support that load over a long period of time without becoming loosened in its hole.

It is a further objective of the present invention to provide a "blind rivet" type of fastener which is utilized to join together two thin panels, for example, two thin sheet metal panels, by inserting the fastener through both panels from one side of one of the panels, without the necessity of forming holes in both panels prior to their being joined together. Alternatively, the panel next to the shelf support member may have a pre-formed hole or both panels may have pre-formed holes.

Other objectives of the present invention will be apparent from the following detailed description which provides the inventor's best mode of practicing the present invention.

BRIEF DESCRIPTION OF THE DRAWINGS

In the drawings which accompany the following detailed description of the present invention and should be considered along with such description.

Although the shelf support member of the present invention is particularly described in connection with the sheet metal panels which form the internal walls of the refrigerator or a freezer, it will be understood that the shelf support member may be used as a support member with other types of sheet metal panels.

The shelf support member of the present invention is particularly adapted for self-insertion through relatively thin sheet metal panels, for example, sheet metal panels having a thickness of from 15 thousandths of an inch through 25 thousandths of an inch. Such thin panels, as may be readily appreciated, provide a particularly difficult environment for a shelf support member and intuitively it may be thought that they would be too thin to hold a support member by frictional contact on the sides of the support member. The "self-insertion" of the support member of the present invention means that the support member forms its own hole when it is pushed, either by machine or by hand, into the sheet metal panel. Alternatively, in thicker sheet metal panels it may be desirable to form a hole in the form of an elongated slot which is slightly shorter in length than the height of the steel fastener member.

Figure 1:
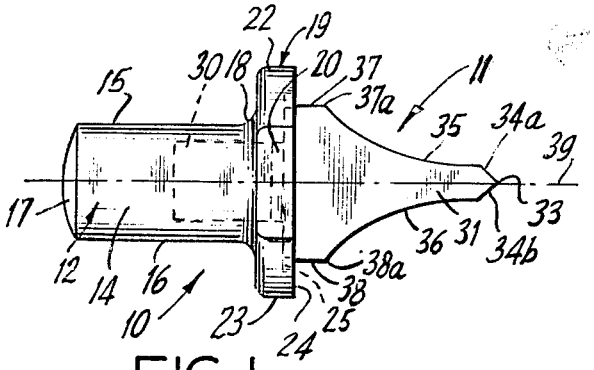
FIG. 1 is a side plan view showing the first embodiment of the shelf support member of the present invention.

As shown in FIG. 1, the shelf support member of the present invention comprises two portions, a support member 10 and a steel fastener 11.

The FIGS. 1, 2, 3 and 4 all show the same shelf support member having the same support member 10. It will be understood, however, as further explained in connection with FIGS. 5 and 6, that the support members may be of other alternative configurations. The support member 10 has, as integral portions thereof, a cylindrical portion 12 having left and right side walls 13 and 14, which are straight-sided walls, and top and bottom curved walls 15 and 16 joining the side walls 13,14. A curved exterior slightly protruding cap portion 17 joins the aforesaid side walls 13,14 and top and bottom walls 15,16. The entire cylindrical portion 12 blends, by curvature 18, into the flange portion 19. The flange portion 19 has straight side walls 20 and 21 which are joined with top and bottom curved walls 22 and 23, respectively.

Figure 2:
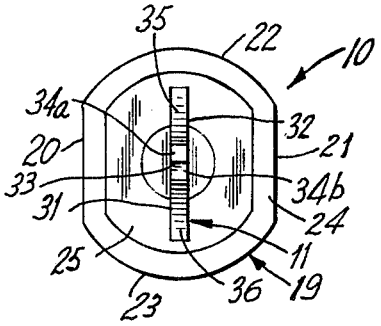
FIG. 2 is a back plan view of the shelf support member of FIG. 1.

As shown in FIG. 2, the back of the flange portion 19 preferably, but not necessarily, has a raised ledge 24 around its periphery. The raised ledge 24 is on a raised level compared to the depressed body portion 25.

The steel fastener 11 is securely encased within the support member 10. For that purpose it has inwardly extending portion 30 which is fastened within support member 10. Preferably the support member 10 is made of a suitable plastic resin. The steel fastener may be molded into the plastic member 10 by wellknown plastic resin injection molding techniques and for that purpose any of a number of well-known plastics may be used for the one-piece plastic member 10, such as nylon, ABS or high-impact polystyrene. Alternatively the fastener may be heat-welded, glued or otherwise secured within the support member 10. Instead of a plastic resin, other materials, such as a zinc alloy suitable for die casting, may be utilized for the support member 10.

Figure 3:
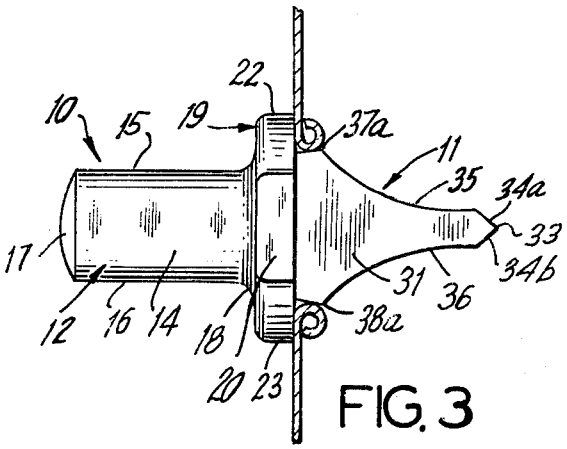
FIG. 3 is a side view showing the shelf support member of FIG. 1 as inserted through a sheet metal panel, for example, the internal wall panel, of a refrigerator.
Figure 4:
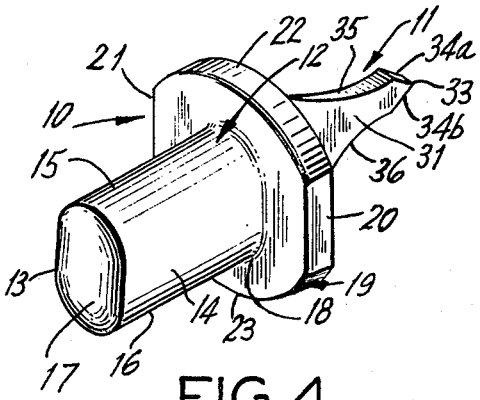
FIG. 4 is a perspective view of the shelf support member of FIG. 1 of the present invention.

The steel fastener 11 is a flat member having side walls 31 and 32 and may be stamped out of relatively thick stiff sheet metal, for example, 1/16 of an inch in thickness or 1/8 of an inch in thickness. As seen in the side view as shown in FIGS. 1 and 3, the steel fastener member has a point 33 and two oppositely directed angled portions 34*a* and 34*b* leading from the aforesaid point 33. The ends of the curved portions 35 and 36 are connected to tapered portions, respectively 37 and 38. The tapered portions 37 and 38 are not parallel to the central axis 39, which is the central axis of the support member. Rather, the tapered portions 37 and 38 are each tapered starting from the respective points 37*a*, 38*a*, and are tapered downwardly (inwardly) towards the flange member 19, i.e., inwardly toward the axis.

Preferably that taper is more than 2 and less than 20° and preferably is about 3°. That tapered portion may have small short serrations to grip the turned-back portion of the metal panel.

Figure 5:
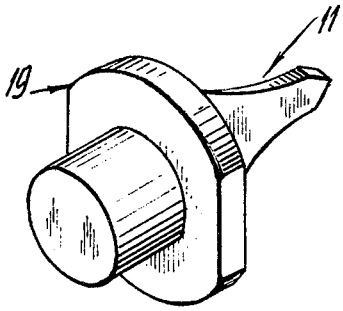
FIG. 5 is a perspective view of an alternative embodiment of a shelf support member within the scope of the present invention.
Figure 6:
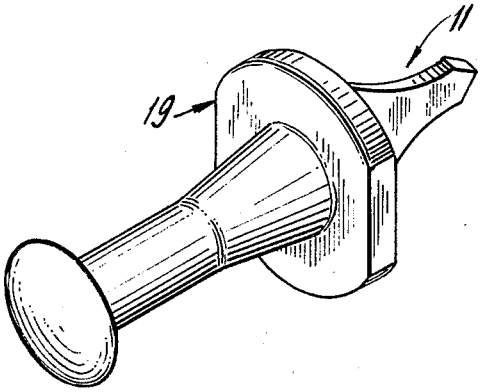
FIG. 6 is a perspective view of a still further embodiment of a shelf support member within the scope of the present invention.

The shelf support members of the alternative embodiments, shown in FIGS. 5 and 6, utilize the same type of steel fastener 11 as was previously described. Their difference, from the prior embodiment of FIGS. 1–4, is that the shelf support cylindrical portion of the shelf support member differs in shape.

In the embodiment of FIG. 5 the shelf support member has a shelf support portion which is a right-sided cylinder whose cross-section, in a plane perpendicular to the axis, is a circle whose end 26 is flat. The flange 19*a* is of the same shape as the flange 19 of the prior embodiment.

In the embodiment shown in FIG. 6 the flange portion 19*b* is also of the same shape as flange portion 19 of the prior embodiment. The shelf support portion 27 has a cylindrical cone portion 36 which merges into flange portion 19*b;* a straight portion 37, which is circular in cross-section in a plane perpendicular to the axis and a cap portion 38 which is rounded on top and circular in cross-section.

Figure 7:
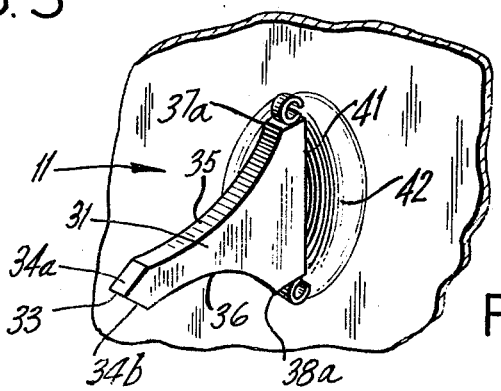
FIG. 7 is a perspective view of the steel fastener which is shown in place and inserted through a panel.

As shown in FIG. 7, the steel fastener 11 is inserted through a thin sheet metal wall panel 29 without the necessity of forming a hole prior to press insertion of the steel fastener 11. The steel fastener, upon being pressed through wall panel 29, forms its own elongated slot and curves back the metal 39*a*, 39*b*. The spring action of the curved-back metal 39*a*, 39*b* acting upon the tapered portions 37,38 provides a surprising and unexpected holding power to secure the steel fastener in the panel wall.

In addition, small flanges of the bent-back panel metal 41 may be formed on both sides of the fastener. These flanges also exert pressure on the fastener and prevent it from being withdrawn from its slot. A still additional aid to retention of the fastener is provided by the bell-like indentation 42 which is formed on the reverse side of the panel. That indentation also aids in exerting force on the fastener in the direction opposing the withdrawal of the fastener from its slot.

The small flanges 41 are metal portions formed when the fastener 11 is pushed through the panel and they exert force inwardly on the two side walls of the fastener. The bell-like indentation 42 is a bending of the metal which forms an indentation (an indentation on the front wall of the panel which is a bulge on the back wall of the panel). That indentation is sufficiently small so that it is hidden by the flange 19 and is not seen by the customer.

What is claimed is:

1. A shelf support member for insertion into a panel comprising:

a one-piece support member, said support member having as portions thereof a flange portion and a support portion projecting from said flange portion, and a metal fastener member having an extension portion which is fastened in said support member and an insertion portion, said insertion portion of said fastener having two flat and parallel sides and two edges, said two edges meeting in a point, which point is adapted to cut the panel for insertion of said fastener, each of said edges having a curved portion starting near said point, each of which curved portions curving outwardly so that the insertion portion at said curved portions becomes wider toward said flange portion, said curved portions rolling back portions of the said panel after insertion of said point through said panel, each of said edges also having a tapered portion, each of said tapered portions being next to and in contact with said flange portion, said tapered portions tapering inwardly toward each other so that they each taper inwardly toward said flange, wherein upon insertion of said fastener through said panel portions of said panel are formed to hold said fastener at its said tapered portions.

2. A shelf support member as in claim 1 wherein said support member is injection-molded of plastic resin and said extension portion is encased in said plastic support member.

3. A shelf support member as in claim 1 wherein said flange portion has a front face and a rear face, and said rear face has thereon a raised ledge about its periphery.

4. A shelf support member as in claim 1 wherein said fastener member is of steel.

* * * * *